United States Patent [19]

Natterer

[11] Patent Number: 4,753,059

[45] Date of Patent: Jun. 28, 1988

[54] PACKAGING MACHINE COMPRISING PRINTING MEANS

[75] Inventor: Johann Natterer, Legau, Fed. Rep. of Germany

[73] Assignee: Multivac Sepp Haggenmuller KG, Wolfertschwenden, Fed. Rep. of Germany

[21] Appl. No.: 870,834

[22] Filed: Jun. 5, 1986

[30] Foreign Application Priority Data

Jun. 7, 1985 [DE] Fed. Rep. of Germany ..... 3520499

[51] Int. Cl.[4] ..... B65B 61/02

[52] U.S. Cl. ..... 53/131; 493/321

[58] Field of Search ..... 53/131; 493/188, 187, 493/321, 325, 324

[56] References Cited

U.S. PATENT DOCUMENTS

| | | | |
|---|---|---|---|
| 565,082 | 8/1896 | Kirshner | 53/131 |
| 3,662,511 | 5/1972 | Eliasberg | 53/131 X |
| 4,068,448 | 1/1978 | Modeen | 53/131 |
| 4,559,755 | 12/1985 | Romagnoli | 53/131 X |

FOREIGN PATENT DOCUMENTS

| | | |
|---|---|---|
| 1794159 | 8/1959 | Fed. Rep. of Germany . |
| 3119204 | 12/1982 | Fed. Rep. of Germany . |

*Primary Examiner*—James F. Coan

*Attorney, Agent, or Firm*—Donald Brown; Robert T. Gammons

[57] ABSTRACT

A packaging machine is provided having an intermittent foil advance with printing means. During the working cycle of the packaging machine the foil is passed through rotary type printing means for obtaining an improved printing format and generating larger printing formats under narrow space conditions.

5 Claims, 4 Drawing Sheets

PACKAGING MACHINE COMPRISING PRINTING MEANS

BACKGROUND OF THE INVENTION

The invention refers to a packaging machine having an intermittent foil advance and printing means. In such a known packaging machine the foil is at rest during the working cycles and is being printed in rest position by means of a plate printer or the like. However, the quality of the plate printers is lower than that of apparatus comprising impression cylinders. Moreover the size of the printing format is limited.

The German Laid Open Print No. 24 01 252 discloses a packaging machine having a continuous advance of the foil to be printed and operating with a rotary printing group. In fact an advance of the foil also takes place between the working cycles of the working stations in the first described type of packaging machines with intermittent foil advance. However, this advance occurs rather jerkilly and with short cycles compared to the working cycles such that so far a rotary printing group cannot be applied to such intermittently operating packaging machine.

OBJECTS OF THE INVENTION

It is a primary object of the invention to provide an improved packaging machine. It is a further object of the invention to provide a packaging machine of the above mentioned kind which may operate with impression cylinders.

SUMMARY OF THE INVENTION

These objects are achieved by a packaging machine comprising a forming station for forming containers in a bottom foil, supply means for supplying a cover foil from a supply roll over said containers, a sealing station for closing the containers with the cover foil, drive means for stepwise advancing said bottom and cover foil between the working cycles of the stations, printing means for printing on said cover foil during the working cycles of the stations and drive means for moving the cover foil through said printing means during said working cycles.

BRIEF DESCRIPTION OF THE DRAWINGS

Further features and advantages of the invention will result from the description of embodiments in connection with the figures. In the Figures.

Figure 1:
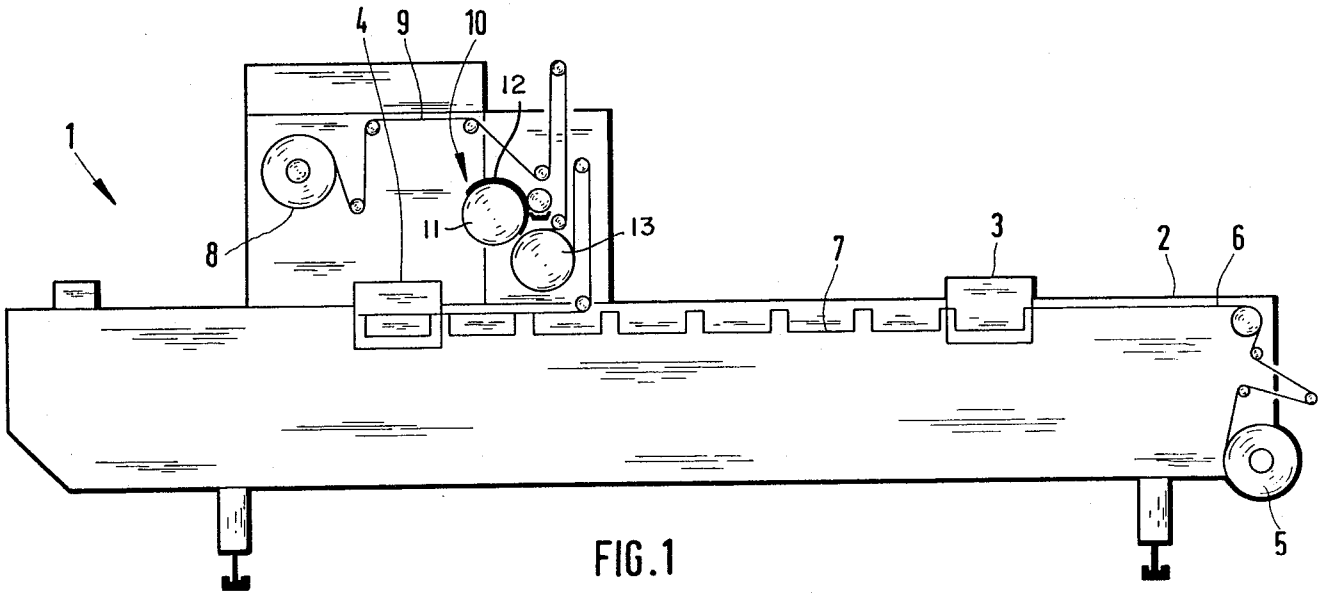
FIG. 1 is a schematic overall view of the packaging machine in which the lateral cover has been omitted for better information.

The packaging machine 1 comprises a machine frame 2, a forming station 3 and a sealing station 4 carried by the frame. A bottom foil is drawn from supply roll 5 and intermittently advanced between respective working cycles of the stations 3 and 4. In the forming station 3 containers 7 are formed which after a filling process are supplied to the sealing station 4. A cover foil 9 is drawn from a second supply roll 8 and supplied to a printing means 10 formed as a rotary printing group. After passing through the printing means 10 the cover foil is guided over the containers 7 and enters the sealing station 4 for closing the containers.

Figure 2:
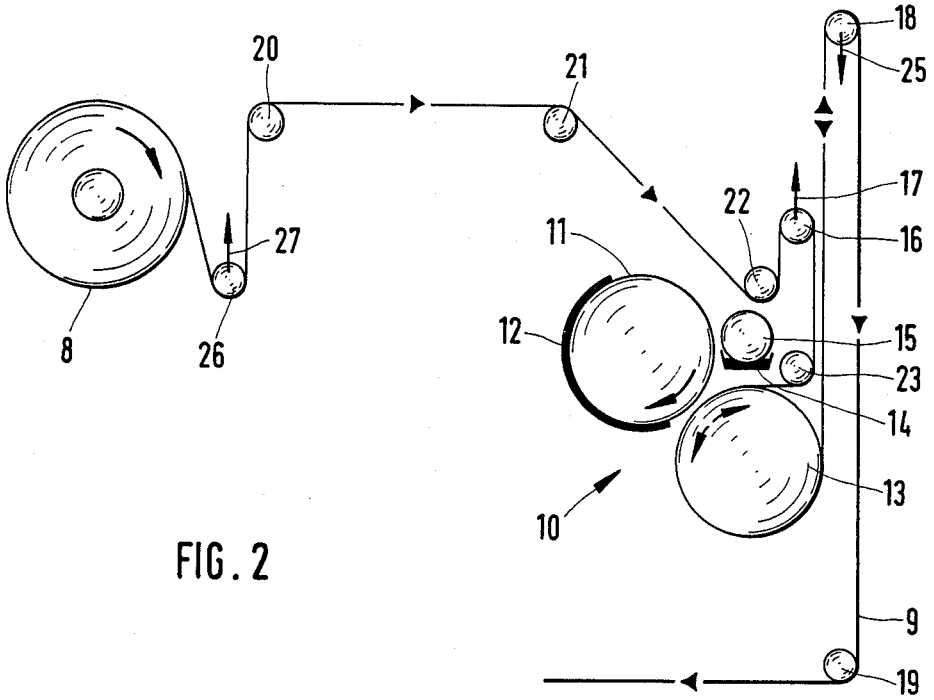
FIG. 2 is a schematic representation of a first embodiment of the invention in a first operating position.
Figure 3:
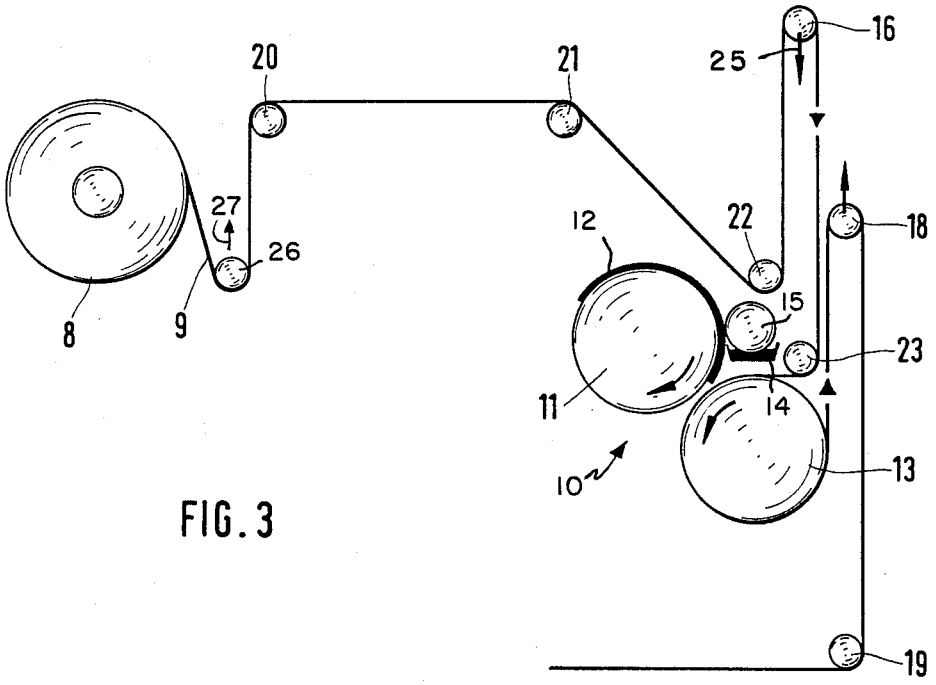
FIG. 3 shows the embodiment of FIG. 2 in a second operating condition.

As may be best seen from the FIGS. 2 and 3 the printing menas 10 comprises a printing drum 11 with the actual printing plate 12 and a counter pressure roller 13 cooperating with the printing drum and rotating in opposite direction as well as a raster or screen roll or anilox roller 15 running in an ink trough 14. The rolls are supported in bearings supported by the machine frame.

Between the supply roll 8 and a stationary deflection roller 19 deflecting the cover foil onto the containers 7 the cover foil 9 is guided around stationary deflection rollers 20 to 23 determining the path of the cover foil between the supply roll 8 and the counter pressure roller 13. Between the deflection rollers 22 and 23 and hence between the supply roll 8 and the counter pressure roller 13 a first roll 16 is provided which is adapted to be movable in upward direction along a path in direction of the arrow 17 such that a length or stretch of the cover foil corresponding to the predetermined path or distance is drawn from the supply roll 8 and held available between the deflection rollers 22 and 23. Furthermore a second roll 18 is provided which is adapted to be movable between the counter pressure roller 13 and the deflection roller 19 on a path in direction of the arrow 25 on or by a predetermined path or distance, respectively, downwards or back upwards into the represented position, respectively, and thus increases the length of the foil between the counter pressure roller 13 and the deflection roller 19 by an amount corresponding to the predetermined path or distance. Moreover, between the supply roll and the deflection roller 20 a kind of looping roller 26 is provided which reciprocates on a path indicated by the arrow 27 and serves to control the foil tension.

Figure 4:
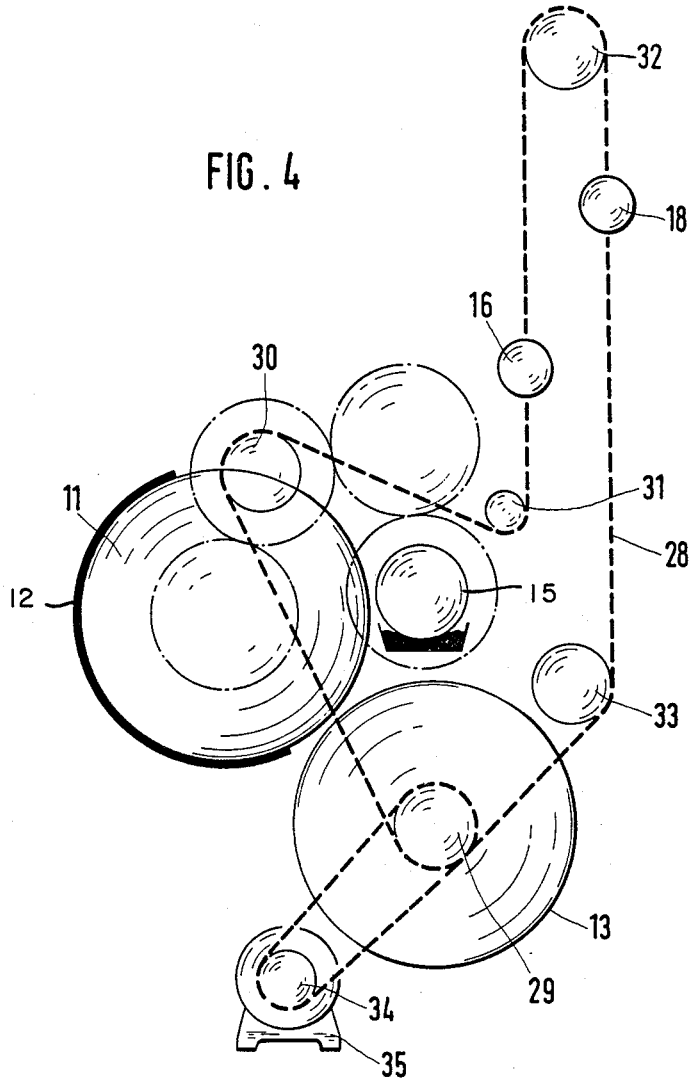
FIG. 4 is a schematic representation of the drive.

As may be seen from FIG. 4 a drive means formed as a circulating chain 28 is provided. The chain 28 runs over a sprocket wheel 29 which is fixedly connected with the counter pressure cylinder 13, a sprocket wheel 30 driving printing drum 11, stationary deflection rollers 31, 32 and 33 as well as a drive sprocket wheel of drive motor 35. The stationary deflection rollers and the motor are supported by the machine frame 2. The screen roll or anilox roller 15 is also driven by the sprocket wheel 30 through a suitable toothed gearing. The sprocket wheel 30 is coupled with the printing drum in a geared manner such that the printing drum 11 rotates with a sense of rotation opposite to that of the counter pressure roller 13. The first roll 16 is non-positively connected with the chain between the deflection rollers 31 and 32. The second roll 18 is non-positively connected with the chain 28 between the deflection rollers 32 and 33. Between the sprocket wheel 29 and the counter pressure roller 13 an overriding clutch is provided which effects that the counter pressure roller 13 is only moved along if the chain 28 moves counterclockwise over the deflection roller 32.

In the advance cycle shown in FIG. 2 which is between the working cycles of the stations the chain 28 is moved clockwise around the deflection roller 32. This moves the roll 16 in direction of the arrow 17 such that in the manner indicated by the arrows the foil is drawn from the supply roll 8 as a stock between the two deflection rollers 22 and 23. At the same time the deflection roller 18 is lowered in direction of the arrow 25, whereby the cover foil which has already passed the printing means 10 is supplied to the sealing station 4. At the end of this movement the rolls 16 and 18 are moved from the position shown in FIG. 2 into the position shown in FIG. 3.

As soon as the advance cycle is terminated the working cycle starts. This working cycle is considerably longer than the advance cycle. Thus the chain 28 is passed with a lower speed around the deflection roller 32 in a counter-clockwise sense. Thus the two rollers 16 and 18 are moved back from the positions shown in FIG. 3 to the starting position shown in FIG. 2. At that time the printing drum 11 and the counter pressure roller 13 are moved in opposite directions in direction of the arrows shown in FIG. 3. It is obtained in this manner that the cover foil drawn on stock with the roll 16 in the preceding working cycle now passes through the printing means and is being printed and held between the printing means 10 and the deflection roller 19 by means of the second roll 18. After the rolls 16 and 18 have arrived at the starting position shown in FIG. 2, the described operations are cyclically repeated. In the next working cycle the printed section held between the counter pressure roller 13 and the deflection roller 19 is moved on and new material is drawn on stock by means of the roll 16 etc.

Figure 5:
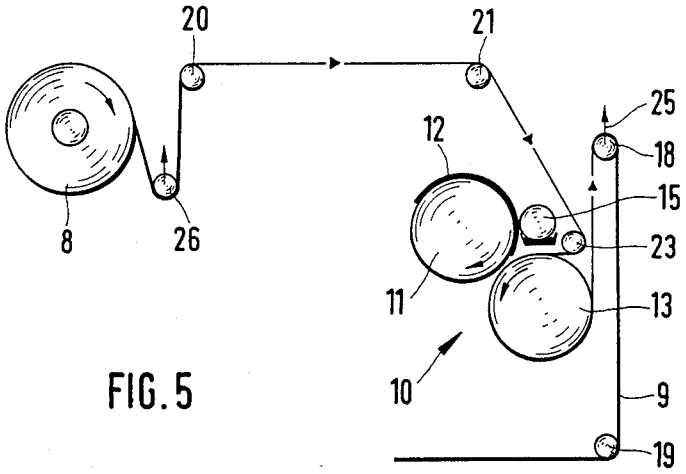
FIG. 5 shows a modified embodiment compared to the first embodiment in a first operating position.
Figure 6:
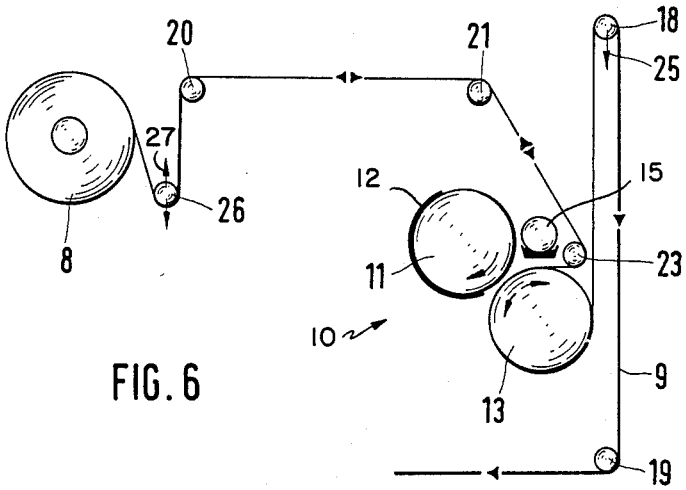
FIG. 6 shows the embodiment of FIG. 5 in the second operating position.

The embodiment shown in the FIGS. 5 and 6 differs from the above described embodiment in that no roll 16 is provided. During the working cycle of the stations and hence of the cycle in which the printing is effected the roll 18 is moved upwards in direction of the arrow 25 in the manner shown in FIG. 5 such that the foil length between the counter pressure cylinder 13 and the deflection roller 19 is increased by drawing the foil drawn from the deflection roller 8 through the printing means 10. In the course of this the roll 18 is moved into the upper end position shown in FIG. 6. In the following advance cycle the roll 18 is moved downwards in the manner shown by the arrow 25 in FIG. 6, whereby the already printed cover foil which is present between the counter pressure cylinder 13 and the deflection roller 19 is released and passed to the sealing station. In the course of this the roll 18 is moved into the lower position shown in FIG. 5. Thereupon the working cycles are repeated.

In both embodiments shown sensors which are for example formed as limit switches are provided in the path of the rolls 16 and 18. The sensors switch off the drive motor 35 whenever the rolls 16 and 18 reach the respective predetermined upper or lower position. The position of the sensors or limit switches, respectively, is adjustable such that the drawn-off section or stretch may be adjusted in correspondence to the size of the printing format determined by the printing plate 12 and that the position of the picture printed onto the cover foil is adjustable as a function of the position of these pictures relative to the containers 7.

In both embodiments an accessory drive (not shown) is provided in addition to the motor 35 in order to rotate on the impression cylinder 11 into the starting position thereof for the next printing cycle in the stage shown in FIGS. 2 and 6.

While the invention has been described in preferred form it is not limited to the precise nature shown as various modifications may be made without departing from the scope of the appended claims.

While the term foil is used in this application this term shall include all kinds of webs and especially plastic webs used in the packaging field.

What is claimed is:

1. Packaging machine comprising a forming station for forming containers in a bottom foil, supply means for supplying a cover foil from a supply roll over said containers, a sealing station for closing the containers with said cover foil, drive means for stepwise advancing said bottom and cover foil between the working cycles of said stations, printing means for printing on said cover foil during said working cycles of said stations and drive means for moving said cover foil through said printing means during said working cycles.

2. The packaging machine of claim 1 wherein said printing means is formed as a rotary printing group.

3. The packaging machine of claim 1 comprising a roll provided between said printing means and said sealing station for moving said cover foil through said printing means during said working cycles.

4. The packaging machine of claim 1 comprising a roll provided between said supply roll and said printing means for drawing the foil which has to be passed through said printing means during the printing operation from said supply roll before said printing operation.

5. The packaging machine of claim 2 comprising a drive means synchronously driving the impression cylinders of the rotary printing group and said roll.

* * * * *